US007898492B2

(12) United States Patent
Williams

(10) Patent No.: US 7,898,492 B2
(45) Date of Patent: Mar. 1, 2011

(54) ANTENNA ARRANGEMENT

(75) Inventor: Neil Williams, Cowfold (GB)

(73) Assignee: ITI Scotland Limited, Glasgow (GB)

( * ) Notice: Subject to any disclaimer, the term of this patent is extended or adjusted under 35 U.S.C. 154(b) by 736 days.

(21) Appl. No.: 11/773,190

(22) Filed: Jul. 3, 2007

(65) Prior Publication Data

US 2008/0094299 A1 Apr. 24, 2008

(30) Foreign Application Priority Data

Jul. 7, 2006 (GB) ..... 0613609.7

(51) Int. Cl.
*H01Q 21/00* (2006.01)

(52) U.S. Cl. ..... 343/836

(58) Field of Classification Search ..... 343/836, 343/700 MD, 702, 725, 746, 771; 29/600
See application file for complete search history.

(56) References Cited

U.S. PATENT DOCUMENTS

| | | | | |
|---|---|---|---|---|
| 4,342,035 | A | 7/1982 | Anderson et al. | |
| 5,130,718 | A | 7/1992 | Wu et al. | |
| 5,394,163 | A | 2/1995 | Bullen et al. | |
| 6,590,545 | B2 * | 7/2003 | McCorkle | 343/830 |
| 7,394,432 | B2 * | 7/2008 | Baliarda et al. | 343/702 |
| 2003/0117337 | A1 | 6/2003 | Lendriet | |
| 2005/0237258 | A1 | 10/2005 | Abramov et al. | |
| 2006/0232479 | A1 | 10/2006 | Walton | |

FOREIGN PATENT DOCUMENTS

| | | | |
|---|---|---|---|
| DE | 3629315 | A1 | 3/1988 |
| GB | 2 294 813 | A | 5/1996 |
| WO | WO 2006/024516 | A1 | 3/2006 |

OTHER PUBLICATIONS

IEEE Transactions on Antennas and Propagation, vol. 50, No. 12, Dec. 2002, Y E Erdemli et al, "Frequency-Selective Surfaces to Enhance Performance of Broad-Band Reconfigurable Arrays", pp. 1716-1724.

(Continued)

*Primary Examiner*—Huedung Mancuso
(74) *Attorney, Agent, or Firm*—Pepper Hamilton LLP

(57) ABSTRACT

There is provided an antenna arrangement for use in an ultra-wideband network, the antenna arrangement comprising a plurality of active elements for emitting radio signals; and a reflecting structure disposed between at least two of the active elements for reflecting radio signals, the reflecting structure comprising an outer reflecting surface for reflecting radio signals in a first frequency range within a frequency band and an inner reflecting surface for reflecting radio signals having a second frequency range within the frequency band. In an alternative embodiment, the antenna arrangement comprises an active element for emitting radio signals, and a reflecting structure. The reflecting structure comprises a first surface for reflecting radio signals having a first frequency range within a frequency band, the first surface being substantially transparent to radio signals outside the first frequency range, and a second surface for reflecting radio signals passed by the first surface, the second surface reflecting radio signals having a second frequency range within the frequency band.

22 Claims, 3 Drawing Sheets

OTHER PUBLICATIONS

Radio Engineering, vol. 15, No. 4, Dec. 2006, I Hertl et al, "Multireflector Antennas—Cascaded Structures with Frequency Selective Surfaces", pp. 80-83.

U.K. Search Report dated Mar. 27, 2007.

Yunus E Erdemli et al: "Frequency-Selective Surfaces to Enhance Performance of Broad-Band Reconfigurable Arrays", IEEE Transactions on Antennas and Propagation, IEEE Service Center, Piscataway, NJ, US, vol. 50, No. 12, Dec. 2002, XP 0110688664, ISSN: 0018-926X, paragraph [00I.]; figs. 1,2,12.

English language Abstract of DE 3629315 A.

Interantional Search Report Dated Oct. 16, 2007.

* cited by examiner

ANTENNA ARRANGEMENT

TECHNICAL FIELD OF THE INVENTION

The invention relates to an antenna arrangement for a communication system, and in particular relates to an antenna arrangement for use in an ultra wideband (UWB) wireless communication system.

BACKGROUND TO THE INVENTION

Ultra-wideband is a radio technology that transmits digital data across a very wide frequency range (3.1 to 10.6 GHz is currently approved by the Federal Communications Commission (FCC) in the United States). It makes use of ultra low transmission power, typically less than −41 dBm/MHz, so that the technology can literally hide under other transmission frequencies such as existing Wi-Fi, GSM and Bluetooth. This means that ultra-wideband can co-exist with other radio frequency technologies. However, this has the constraint of limiting communication to distances of typically 5 to 20 metres.

In one approach, ultra-wideband uses very short impulses, often of the duration of nanoseconds (ns) or less, to transfer information. These pulses give rise to spectral components covering a very wide bandwidth in the frequency spectrum, hence the term ultra-wideband, whereby the bandwidth occupies more than 20 percent of the centre frequency, typically at least 500 MHz.

In an alternative approach, the wide bandwidth is used to transmit information via a large number of orthogonal frequency carriers, organised into sub-bands; this is called Multi-Band Orthogonal Frequency Division Multiplexing (MB-OFDM).

These properties of ultra-wideband, coupled with the very wide bandwidth, mean that UWB is an ideal technology for providing high-speed wireless communication in the home or office environment, whereby the communicating devices are within a range of 20 m of one another.

FIG. 1 shows the arrangement of frequency bands in a Multi Band Orthogonal Frequency Division Multiplexing (MB-OFDM) system for ultra-wideband communication. The MB-OFDM system comprises fourteen sub-bands of 528 MHz each, and uses frequency hopping every 312 ns between sub-bands as an access method. Within each sub-band QPSK coding is employed to transmit data. It is noted that the sub-band around 5 GHz, currently 5.1-5.8 GHz, is left blank to avoid interference with existing narrowband systems, for example 802.11a WLAN systems, security agency communication systems, or those used in the aviation industry.

The fourteen sub-bands are organised into five band groups, four having three 528 MHz sub-bands, and one band group having two 528 MHz sub-bands, As shown in FIG. 1, the first band group comprises sub-band 1, sub-band 2 and sub-band 3. An example UWB system will employ frequency hopping between sub-bands of a band group, such that a first data symbol is transmitted in a first 312.5 ns duration time interval in a first frequency sub-band of a band group, a second data symbol is transmitted in a second 312.5 ns duration time interval in a second frequency sub-band of a band group, and a third data symbol is transmitted in a third 312.5 ns duration time interval in a third frequency sub-band of the band group. Therefore, during each time interval a data symbol is transmitted in a respective sub-band having a bandwidth of 528 MHz, for example sub-band 2 having a 528 MHz baseband signal centred at 3960 MHz.

The technical properties of ultra-wideband mean that it is being deployed for applications in the field of data communications. For example, a wide variety of applications exist that focus on cable replacement in the following environments:

- communication between PCs and peripherals, i.e. external devices such as hard disc drives, CD writers, printers, scanner, etc.
- home entertainment, such as televisions and devices that connect by wireless means, wireless speakers, etc.
- communication between handheld devices and PCs, for example mobile phones and PDAs, digital cameras and MP3 players, etc.

The antenna arrangements used in ultra-wideband systems are usually omni-directional, meaning that radio signals are emitted in all directions from an active radiating element, or elements. However, in future systems, which are targeted at very high data rate applications, there are benefits in using a number of higher gain elements, each of which covers a specific angular sector.

Although travelling wave elements can be used which offer the wide bandwidth required by an ultra-wideband network, an array of such elements is relatively large.

An array of low gain active elements (such as monopoles) can be used with a plane reflector surface which directs the signals in the required sectors. However, although the use of plane reflector surfaces to reflect radio signals in a desired direction is known, they are not suitable for use in ultra-wideband networks due to the large bandwidths used in these networks, because the physical distance between an active element and the reflective surface is normally chosen to be an optimum fraction of the operating wavelength. Due to the wide range of frequencies employed in a UWB system, an antenna with a fixed distance between the active element and the reflective surface will not function properly over the full bandwidth.

It is known that it is possible to adapt an antenna such that the physical distance between the active element and the reflector is changed according to the frequency being transmitted, for example by physically moving the reflector in relation to the active element, or vice versa. However, such arrangements are unsuitable for use with UWB systems in which the antenna must be capable of changing frequencies at extremely high speeds.

It is therefore an object of the invention to provide an antenna arrangement for use in an ultra-wideband system that overcomes the problems with the above conventional arrangements.

SUMMARY OF THE INVENTION

According to a first aspect of the invention, there is provided an antenna arrangement for use in an ultra-wideband network, the antenna arrangement comprising a plurality of active elements for emitting radio signals; and a reflecting structure disposed between at least two of the active elements for reflecting radio signals, the reflecting structure comprising an outer reflecting surface for reflecting radio signals in a first frequency range within a frequency band and an inner reflecting surface for reflecting radio signals having a second frequency range within the frequency band.

In one embodiment, the first frequency range comprises a set of frequencies which are higher than the set of frequencies in the second frequency range.

In one embodiment, the distance between an active element and a corresponding reflecting surface is dependent on the frequency range of the radio signals reflected by said reflecting surface.

In one embodiment, the distance between an active element and a corresponding reflective surface is equal to one quarter of the wavelength of a centre frequency in the frequency range reflected by said surface.

In one embodiment, the antenna arrangement further comprises at least one additional inner reflecting surface between the outer reflecting surface and the inner reflecting surface, each at least one additional inner reflecting surface being suitable for reflecting radio signals having a frequency range between the first and second frequency ranges reflected by the outer reflecting surface and the inner reflecting surface.

In one embodiment, the reflecting surfaces are planar.

In an alternative embodiment, the reflecting surfaces are curved.

In one embodiment, each active element is individually controllable.

In one embodiment, each frequency range is approximately 528 MHz wide.

In an alternative embodiment, the frequency range is a multiple of 528 MHz wide.

According to another aspect of the present invention, there is provided an antenna arrangement for use in an ultra-wideband network. The antenna arrangement comprises an active element for emitting radio signals, and a reflecting structure. The reflecting structure comprises a first surface for reflecting radio signals having a first frequency range within a frequency band, the first surface being substantially transparent to radio signals outside the first frequency range. The reflecting structure also comprises a second surface for reflecting radio signals passed by the first surface, the second surface reflecting radio signals having a second frequency range within the frequency band.

BRIEF DESCRIPTION OF THE DRAWINGS

For a better understanding of the present invention, and to show more clearly how it may be carried into effect, reference will now be made, by way of example only, to the following drawings in which.

DETAILED DESCRIPTION OF THE PREFERRED EMBODIMENTS

Although the invention will be described further herein as being adapted for use in an ultra wideband network, it will be appreciated that the invention can be adapted for use in other types of network.

Figure 2:
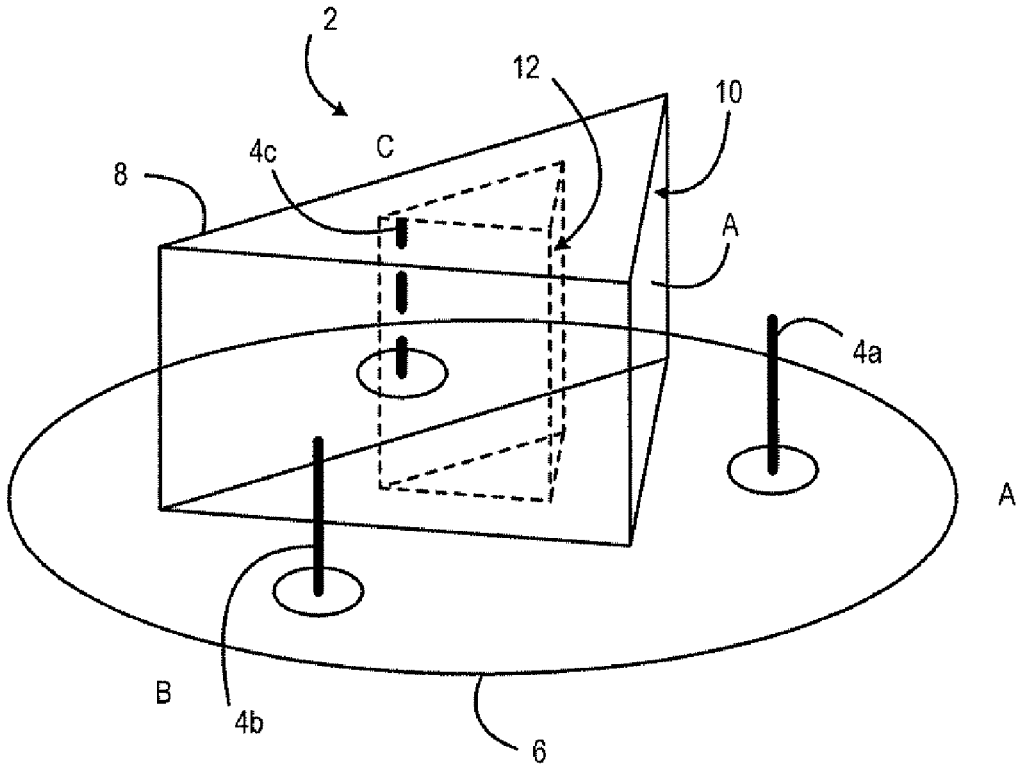
FIG. 2 shows an antenna arrangement in accordance with one embodiment of the invention.
Figure 3:
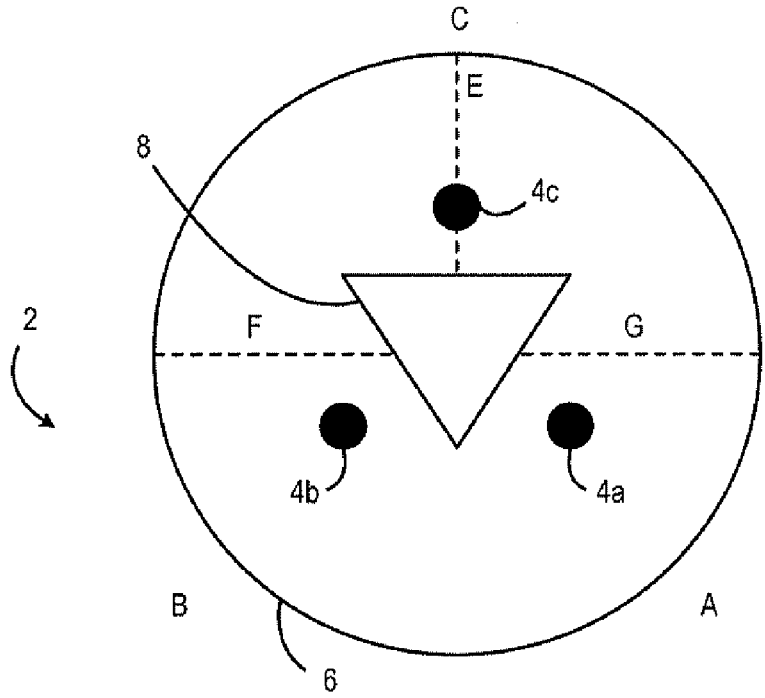
FIG. 3 is a top view of the antenna arrangement of FIG. 2.

FIG. 2 is a perspective view of an antenna arrangement 2 in accordance with an exemplary embodiment of the invention. FIG. 3 is a top view of the antenna arrangement 2 of FIG. 2. The antenna arrangement 2 comprises three active radiating elements 4*a*, 4*b* and 4*c* mounted on a base portion 6. In this exemplary embodiment, the active elements 4 are in the form of omni-directional monopoles, although other forms of element could be used, such as dipoles. For example, each active element 4 may comprise several distinct components.

Each active element 4 is connected to respective transmitter circuitry (not shown) which provides the signals to be emitted by that active element 4. One or more active element 4 can be active at any particular time. Each active element 4 can alternatively be connected to respective receiver circuitry if the antenna arrangement 2 is to be used for receiving radio signals, or to respective transceiver circuitry if the antenna arrangement 2 is to be used for transmitting and receiving radio signals. In a further alternative, switched transmitter/receiver outputs can also be used in place of the dedicated transmitter and receiver circuitry.

In this exemplary embodiment, the antenna arrangement 2 is used to generate three different coverage sectors, A, B and C, each being served by a respective active element 4*a*, 4*b* or 4*c*.

In accordance with the invention, a reflecting structure 8 is provided between some or all of the active elements 4. The reflecting structure 8 has a shape designed to create the desired sector pattern from the active elements 4. In this embodiment, three sectors are required from the three active elements 4*a*, 4*b* and 4*c*, so the reflecting structure 8 has a uniform triangular cross-section when viewed from above, with each surface of the structure 8 facing a respective active element 4*a*, 4*b* or 4*c*.

The reflecting structure 8 has an outer reflecting surface 10 (which may or may not be at the surface of the reflecting structure 8) and at least one inner reflecting surface 12. The outer reflecting surface 10 and each inner reflecting surface 12 is a frequency selective surface (FSS) each of which is suitable for reflecting radio signals at a particular frequency, or range of frequencies around a central frequency (i.e. each surface can reflect a particular frequency or range of frequencies within a frequency band). At frequencies outside the range over which it is designed to be reflective, the frequency selective surface is partially or totally transparent and allows energy to pass through to the surface(s) behind. The innermost surface 12 can be a high conductivity reflective surface.

In a UWB application, for example, the reflecting structure 8 may consist of three separate surfaces:

- an outer surface which is reflective in a first frequency range within the UWB frequency band and transparent at lower frequencies, for example reflective in the frequency range from 8.1 GHz to 10.5 GHz and transparent at lower frequencies;
- an intermediate surface which is reflective in a second frequency range within the UWB frequency band and transparent elsewhere, for example reflective from 5.6 GHz to 8.1 GHz and transparent elsewhere; and
- an inner layer which is reflective at a third frequency range within the UWB band or, alternatively, purely reflective at all frequencies in the band.

Figure 1:
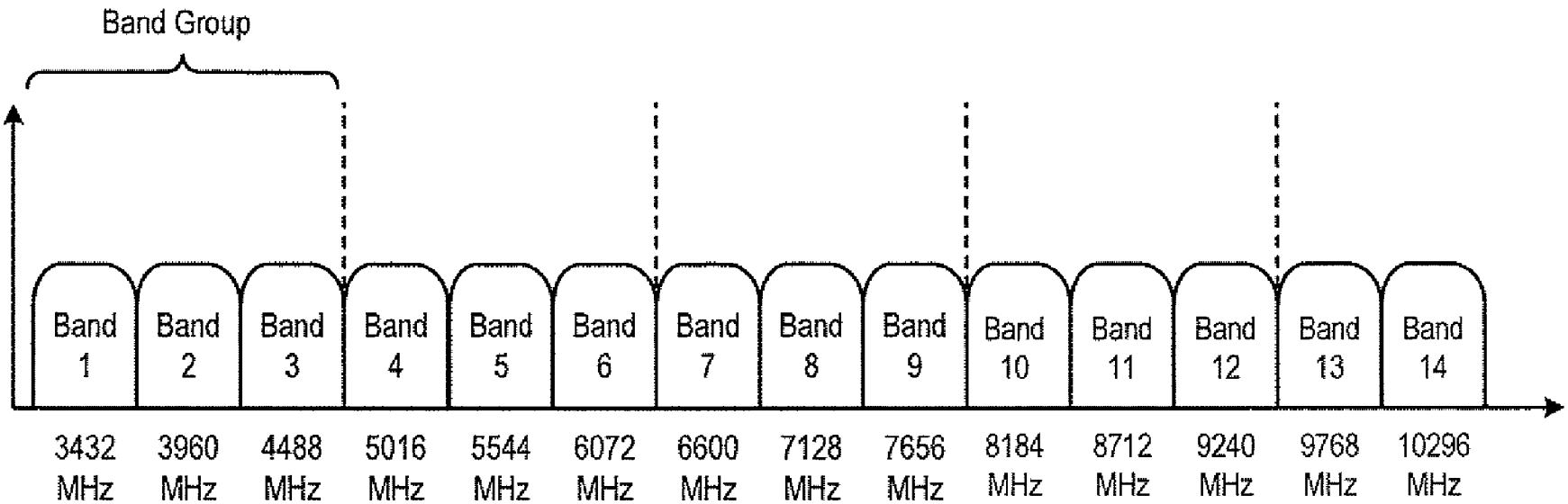
FIG. 1 shows the multi-band OFDM alliance (MBOA) approved frequency spectrum of a MB-OFDM system.

Referring to FIG. 1, the reflecting surfaces in the reflecting structure 8 may reflect frequencies in single or multiple frequency bands, single or multiple band groups, or frequencies across the whole ultra-wideband frequency spectrum. It will be appreciated, however, that it is not necessary for the range of frequencies reflected by each surface 10, 12 in the reflecting structure 8 to correspond to a particular band or sub-band in the arrangement shown in FIG. 1, as illustrated by the example in the paragraph above.

In order for the reflecting structure 8 to provide a coherent reflected beam in each of the sectors A, B and C, the distance between reflecting surfaces 10, 12 and the respective active element 4*a*, 4*b* and 4*c* is dependent on the frequency range to be reflected by each reflecting surface 10, 12. For example, the specific distance between a reflecting surface 10, 12 and a corresponding active element 4*a*, 4*b*, 4*c* is chosen such that it relates to the wavelength of the centre frequency in the frequency range reflected by that surface. Preferably, the distance between an active element and a corresponding reflective surface is equal to one quarter of the wavelength of a centre frequency in the frequency range reflected by said surface.

Referring to FIGS. 2 and 3, each active element 4 is omnidirectional, in that they radiate radio signals in all directions and across a particular frequency band. Radio signals incident on the reflecting structure 8 are reflected by the reflecting surface 10, 12, appropriate to the frequency of that part of the radio signal. At any point in the far-field (i.e. away from the reflecting structure 8 and active element 4), the direct signals from the active element 4 and the reflected signals from the reflecting structure 8 are added together to produce a composite signal which is dependent on the angle from the line perpendicular to the plane of the reflecting structure 8.

If the separation of the active element 4 from the appropriate reflecting surface 10, 12 is approximately equal to a quarter of the free-space operating wavelength of the radio signal (i.e. $\lambda/4$), then the direct and reflected signals are added in the forward direction (e.g. the direction indicated by line E for sector C of FIG. 3) and cancelled at angles of +/−90° to the forward direction (e.g. the directions indicated by lines F and G for sector C of FIG. 3). This results in a coherent radio signal beam from each active element 4 in its respective sector A, B or C.

Therefore, in preferred embodiments of the invention, in order to generate coherent reflected radio signal beams, the outer reflecting surface 10 is designed to reflect radio signals having a first frequency range and the inner reflecting surface 12 is designed to reflect radio signals having a second frequency range, where the first frequency range comprises a set of frequencies that are higher than the set of frequencies comprising the second frequency range.

As mentioned above, the reflecting structure 8 includes at least one inner reflecting surface 12. In preferred embodiments, the reflecting structure 8 includes a plurality of inner reflecting surfaces 12, with each successive inner reflecting surface 12 (i.e. each surface moving towards the centre of the reflecting structure 8) reflecting radio signals having a lower frequency than the preceding reflecting surface 12. If a sufficient number of reflecting surfaces 10, 12 are used, the reflecting structure 8 can provide a coherent reflected beam across the entire frequency band of a UWB system.

For example, a first reflective surface 10 can be used to reflect frequencies corresponding to a first UWB band group, a second reflective surface 12 used to reflect frequencies corresponding to a second UWB band group, and so on.

It will be appreciated that although the reflecting surfaces 10, 12 are shown to be planar in FIGS. 2 and 3, the reflecting surfaces 10, 12 can alternatively be curved, or can be any other appropriate shape, such as a conic section.

The invention described above has the advantage of providing an antenna arrangement that can handle a wide range of frequencies, and which is capable of switching rapidly from one set of frequencies to another.

Figure 4:
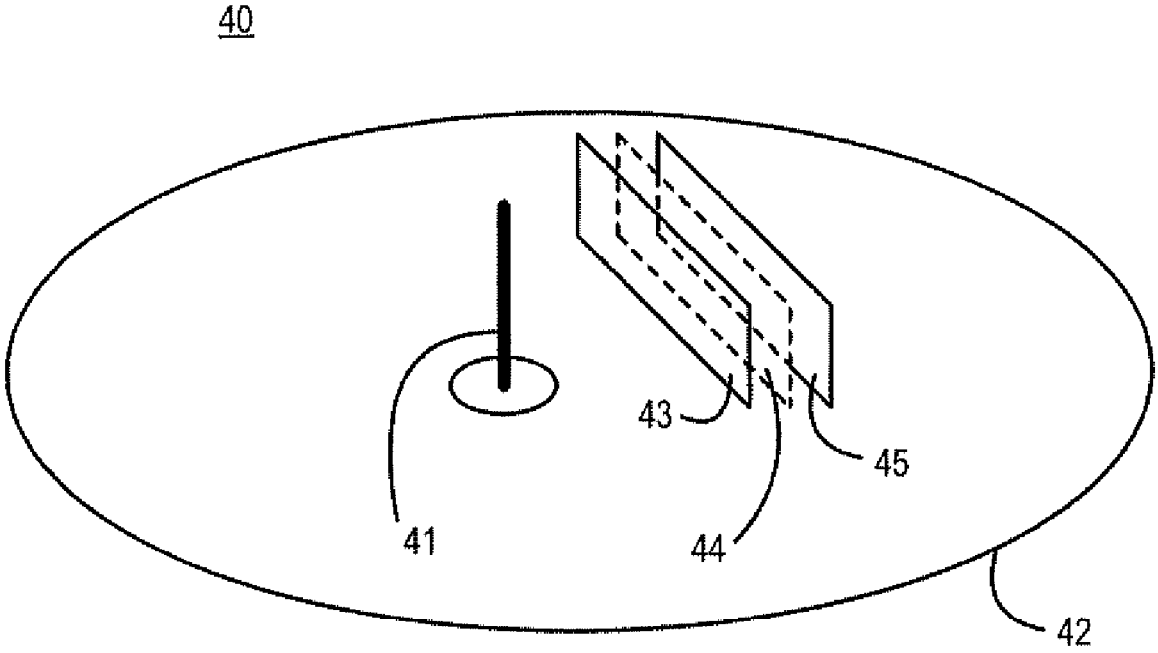
FIG. 4 shows an antenna arrangement in accordance with a second embodiment of the present invention.

FIG. 4 shows an antenna arrangement 40 according to another embodiment of the present invention. According to FIG. 4, an active element 41 is connected to respective transmitter circuitry (not shown) which provides the signals to be emitted by that active element 41. The active element 4 can alternatively be connected to respective receiver circuitry if the antenna arrangement 40 is to be used for receiving radio signals, or to respective transceiver circuitry if the antenna arrangement 40 is to be used for transmitting and receiving radio signals.

The antenna arrangement 40 comprises a reflecting structure that includes a first surface 43 and a second surface 45. The first surface 43 reflects radio signals having a first frequency range within a frequency band, and is substantially transparent to radio signals outside the first frequency range. The second surface 45 reflects radio signals passed by the first surface 43, and reflects radio signals having a second frequency range within the frequency band.

In this manner, the antenna arrangement can handle first and second frequency ranges without having any mechanically moving components, thereby enabling the antenna arrangement to switch between a first set of frequencies and a second set of frequencies at high speed.

The distance between the active element 41 and the first surface 43 is dependent on the frequency range of the radio signals to be reflected by the first surface 43, i.e. the first frequency range. Likewise, the distance between the active element 41 and the second surface 45 is dependent on the frequency range of the radio signals to be reflected by the second surface 45, i.e. the second frequency range.

Preferably, the distance between the active element 41 and the first and second surfaces 43, 45, respectively, is equal to one quarter of the wavelength of a centre frequency in the frequency range reflected by said first and second surface 43, 45.

In a preferred embodiment, the reflecting structure includes one or more additional surfaces 44 between the first surface 43 and the second surface 45. The additional surface 44 is suitable for reflecting radio signals in a third frequency range, and is substantially transparent to radio signals at least in the second frequency range. In this way each successive surface 43, 44, 45 (i.e. each surface moving away from the active element 41) is configured to reflect radio signals having a lower frequency than the preceding reflecting surface. If a sufficient number of reflecting surfaces 43, 44, 45 are used, the reflecting structure can provide a coherent reflected beam across the entire frequency band of a UWB system.

For example, surface 43 can be used to reflect frequencies corresponding to a first UWB band group, surface 44 used to reflect frequencies corresponding to a second UWB band group, surface 45 used to reflect frequencies corresponding to a third UWB band group, and so on.

In FIG. 4 the surfaces 43, 44, 45 are shown as being planar. However, it will be appreciated that at least one of the surfaces may be curved, or any other appropriate shape, such as a conic section.

It is noted that although the frequency ranges in the preferred embodiments have been described in the order of GHz, the frequency range can be of any order, including MHz or even single Hz for certain applications. In addition, it is noted that a reference to a frequency range being within a frequency band does not exclude the possibility of a frequency range being the same as a frequency band, for example when the inner reflective surface is arranged to be purely reflective at all frequencies in a frequency band.

It should be noted that the above-mentioned embodiments illustrate rather than limit the invention, and that those skilled in the art will be able to design many alternative embodiments without departing from the scope of the appended claims. The word "comprising" does not exclude the presence of elements or steps other than those listed in a claim, "a" or "an" does not exclude a plurality, and a single processor or other unit may fulfil the functions of several units recited in the claims. Any reference signs in the claims shall not be construed so as to limit their scope.

The invention claimed is:

1. An antenna arrangement for use in an ultra-wideband network, the antenna arrangement comprising:

a plurality of active elements for emitting radio signals, each active element being configured to emit radio signals in first and second frequency ranges within a frequency band; and a reflecting structure disposed between at least two of the active elements for reflecting radio signals, the reflecting structure comprising:

a first reflecting surface for reflecting radio signals having a frequency within the first frequency range, the first reflecting surface configured to be at least partially transparent to radio signals having a frequency outside the first frequency range; and a second reflecting surface for reflecting radio signals having a frequency within the second frequency range.

2. An antenna arrangement as claimed in claim 1, wherein the first frequency range consists exclusively of a set of frequencies which are higher than a set of frequencies included in the second frequency range.

3. An antenna arrangement as claimed in claim 1, wherein the distance between an active element and a corresponding reflecting surface is dependent on the frequency range of the radio signals reflected by said reflecting surface.

4. An antenna arrangement as claimed in claim 3, wherein the distance between an active element and a corresponding reflective surface is equal to one quarter of the wavelength of a centre frequency in the frequency range reflected by said surface.

5. An antenna arrangement as claimed in claim 1, further comprising a third reflecting surface between the first reflecting surface and the second reflecting surface, the third reflecting surface being suitable for reflecting radio signals in a third frequency range, and being configured to be at least partially transparent to radio signals having a frequency outside the third frequency range.

6. An antenna arrangement as claimed in claim 5, wherein said third reflecting surface is suitable for reflecting radio signals having a frequency range between the first and second frequency ranges reflected by the first reflecting surface and the second reflecting surface.

7. An antenna arrangement as claimed in claim 1, wherein the reflecting surfaces are planar.

8. An antenna arrangement as claimed in claim 1, wherein the reflecting surfaces are curved.

9. An antenna arrangement as claimed in claim 1, wherein each active element is individually controllable.

10. An antenna arrangement as claimed in claim 1, wherein each frequency range is approximately 528 MHz wide.

11. An antenna arrangement as claimed in claim 1, wherein each frequency range is a multiple of 528 MHz wide.

12. A method for reflecting radio signals in an ultra-wideband network, comprising:

providing a plurality of active elements for emitting radio signals, each active element being suitable for emitting radio signals in first and second frequency ranges within a frequency band; and reflecting radio signals by arranging a reflecting structure between at least two of the active elements, wherein the reflecting step comprises:

reflecting radio signals having a frequency within the first frequency by a first reflecting surface of the reflecting structure the first reflecting surface configured to be at least partially transparent to radio signals having a frequency outside the first frequency range; and reflecting radio signals having a frequency within the second frequency range by a second reflecting surface of the reflecting structure.

13. A method as claimed in claim 12, wherein the first frequency range consists exclusively of a set of frequencies which are higher than a set of frequencies included in the second frequency range.

14. A method as claimed in claim 12, wherein the distance between an active element and a corresponding reflecting surface is dependent on the frequency range of the radio signals reflected by said reflecting surface.

15. A method as claimed in claim 12, wherein the distance between an active element and a corresponding reflective surface is equal to one quarter of the wavelength of a centre frequency in the frequency range reflected by said surface.

16. A method as claimed in claim 12, further comprising reflecting radio signals in a third frequency range by a third reflecting surface between the first reflecting surface and the second reflecting surface the third reflecting surface being configured to be at least partially transparent to radio signals having a frequency outside the third frequency range.

17. A method as claimed in claim 16, wherein said third reflecting surface is suitable for reflecting radio signals having a frequency range between the first and second frequency ranges reflected by the first reflecting surface and the second reflecting surface.

18. A method as claimed in claim 12, wherein the reflecting surfaces are planar.

19. A method as claimed in claim 12, wherein the reflecting surfaces are curved.

20. A method as claimed in claim 12, further comprising individually controlling each active element.

21. A method as claimed in claim 12, wherein each frequency range is approximately 528 MHz wide.

22. A method as claimed in claim 12, wherein each frequency range is a multiple of 528 MHz wide.

* * * * *